United States Patent [19]

Laditka

[11] Patent Number: 4,603,999

[45] **Date of Patent: * Aug. 5, 1986**

[54] APPARATUS FOR MIXING AND SPREADING COATINGS ON SURFACES

[76] Inventor: Alexander Laditka, #C-10 4741 Dalebridge Rd., Warrensville Hts., Ohio 44128

[ * ] Notice: The portion of the term of this patent subsequent to Oct. 16, 2001 has been disclaimed.

[21] Appl. No.: 532,742

[22] Filed: Sep. 16, 1983

Related U.S. Application Data

[63] Continuation-in-part of Ser. No. 408,484, Aug. 16, 1982, Pat. No. 4,477,203.

[51] Int. Cl.[4] ..... E01C 19/22

[52] U.S. Cl. ..... 404/112; 404/113; 366/66; 366/67; 366/312; 15/372; 51/177

[58] Field of Search ..... 404/112, 101, 108, 113, 404/118; 51/172, 177; 16/24, 25, 36, 41, DIG. 27; 366/309, 312, 65–67; 15/49 R, 50 R, 180, 372, 385

[56] References Cited

U.S. PATENT DOCUMENTS

| | | | |
|---|---|---|---|
| 782,459 | 2/1905 | Morris | 222/368 |
| 831,494 | 9/1906 | Alexander | 16/24 |
| 1,224,294 | 5/1917 | Franzen | 16/41 X |
| 1,437,863 | 12/1922 | Raymond | 222/317 |

(List continued on next page.)

FOREIGN PATENT DOCUMENTS

| | | | |
|---|---|---|---|
| 945037 | 12/1963 | United Kingdom | 15/49 R |

OTHER PUBLICATIONS

Seal Master Blacktop Sealing Machine Brochure and Three Accompanying Photographs, Wikel Mfg. Corp.
Huber SC-150 Sealcoat Applicator Brochure, Huber Co.
Nu-Serf Seal Applicator Brochure, Gierhart Machinery Co.
Asphalt Sealing Machine Brochure, Allied Steel & Tractor Products, Inc.
The New Surf-Seal for Asphalt Sealcoating Brochure, Specialized Equipment of Wakeman.
Seal-Master Applicator Brochure, Wikel Mfg. Co.
Now the Erie Applicator Brochure, Erie Applicator, Inc.

*Primary Examiner*—James A. Leppink
*Assistant Examiner*—John F. Letchford
*Attorney, Agent, or Firm*—David A. Burge

[57] ABSTRACT

An apparatus for uniformly spreading and mixing coating ingredients deposited on a traffic surface, such as a road, includes a maneuverable, wheeled support carriage, a frame and a power driven finishing assembly. The finishing assembly is provided with a plurality of working tools which are rotated about a central axis to bring the tools sequentially into contact with a traffic surface area being treated to efficiently spread and apply a surface treatment composition. Radially extending arms connect with the working tools and with a central support disc. The arms independently urge the tools toward the traffic surface to maintain the tools in contact with the surface despite surface variations. Adjustable couplings connect the tools to the arms to enable the tools to assume a range of operating angles relative to the arms to further enhance the maintenance of good tool-to-surface contact. In preferred practice, the tools include a spreading tool which takes the form of a blade, and a mixing tool which takes the form of a rake. Blade and rake tools preferably are mounted in an alternating array for sequential exposure of one followed by the other of these tools to a surface being treated. The tools are rotated about the central axis by an engine-driven gear reducer. Movement of the apparatus over a surface being treated is preferably effected manually by an operator who applies force to a frame-carried handle. The support carriage is preferably provided with a plurality of centrally mounted, ball-type wheels which permit the operator to readily maneuver the machine and effect coating operations within small treatment areas and within areas having irregular boundaries.

14 Claims, 14 Drawing Figures

U.S. PATENT DOCUMENTS

| | | | |
|---|---|---|---|
| 1,591,682 | 7/1926 | Ponselle | 51/177 X |
| 1,914,950 | 6/1933 | Kanen | 404/111 |
| 2,033,510 | 3/1936 | Brayley | 16/24 |
| 2,241,214 | 5/1941 | Milster | 188/16 |
| 2,668,976 | 2/1954 | Beach | 15/230 |
| 2,717,725 | 9/1955 | Bennett | 222/485 |
| 2,725,945 | 11/1955 | Beaudoux et al. | 188/16 |
| 2,754,733 | 7/1956 | Beyer | 404/112 |
| 2,779,965 | 2/1957 | Schilberg | 16/41 X |
| 2,796,203 | 6/1957 | Masters et al. | 222/311 |
| 2,799,037 | 7/1957 | Grogan | 15/172 |
| 2,835,420 | 5/1958 | Foley | 222/485 |
| 3,130,653 | 4/1964 | Talbott | 404/112 |
| 3,183,803 | 5/1965 | Gierhart | 404/111 |
| 3,187,845 | 6/1965 | Ashley, Jr. et al. | 188/16 |
| 3,221,619 | 12/1965 | Erickson | 404/112 |
| 3,279,337 | 10/1966 | Weaver | 404/111 |
| 3,283,675 | 11/1966 | Gifford et al. | 404/111 |
| 3,305,887 | 2/1967 | Turner | 15/50 |
| 3,333,518 | 8/1967 | Sholl et al. | 404/92 |
| 3,452,381 | 6/1969 | Bratti | 15/98 |
| 3,458,885 | 8/1969 | Danielsson | 15/50 |
| 3,515,041 | 6/1970 | Murtaugh | 404/108 |
| 3,533,336 | 10/1970 | Wikel | 404/111 |
| 3,559,543 | 2/1971 | Schwoebel, Jr. | 404/101 |
| 3,580,638 | 5/1971 | Pullen | 299/41 |
| 3,683,761 | 8/1972 | Babic | 404/112 |
| 3,703,856 | 11/1972 | Wikel et al. | 404/111 |
| 3,776,430 | 12/1973 | Grandrud | 222/177 |
| 3,791,754 | 2/1974 | Zochil | 404/112 |
| 3,841,779 | 10/1974 | Ray | 404/111 |
| 3,989,403 | 12/1976 | Verive | 404/111 |
| 4,074,385 | 2/1978 | Howard et al. | 15/49 R X |
| 4,096,879 | 6/1978 | Serur et al. | 251/121 |
| 4,172,580 | 10/1979 | Raftis et al. | 251/8 |
| 4,302,128 | 11/1981 | Thatcher | 404/111 |
| 4,318,631 | 3/1982 | Vickers | 404/118 X |
| 4,477,203 | 10/1984 | Laditka | 404/111 |

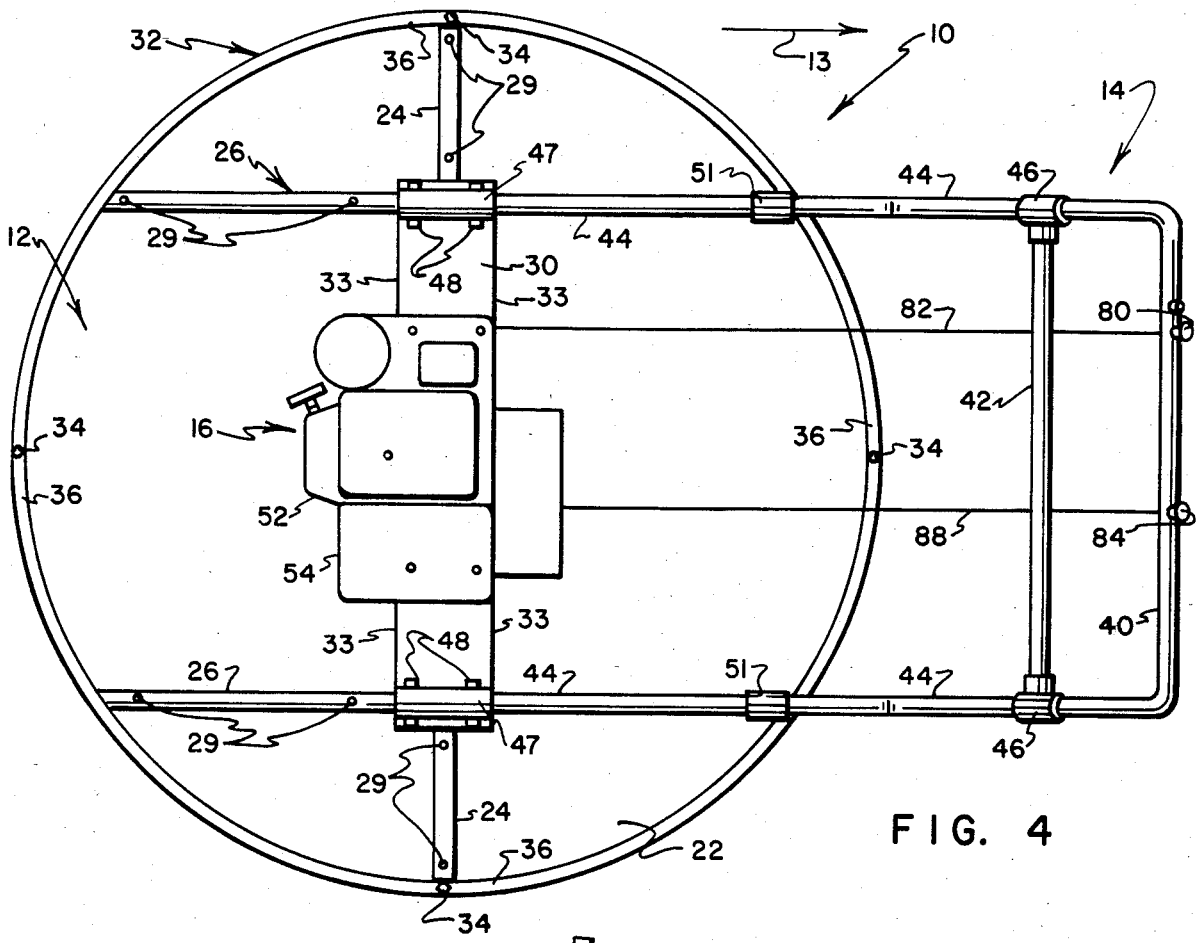
FIG. 4
FIG. 5
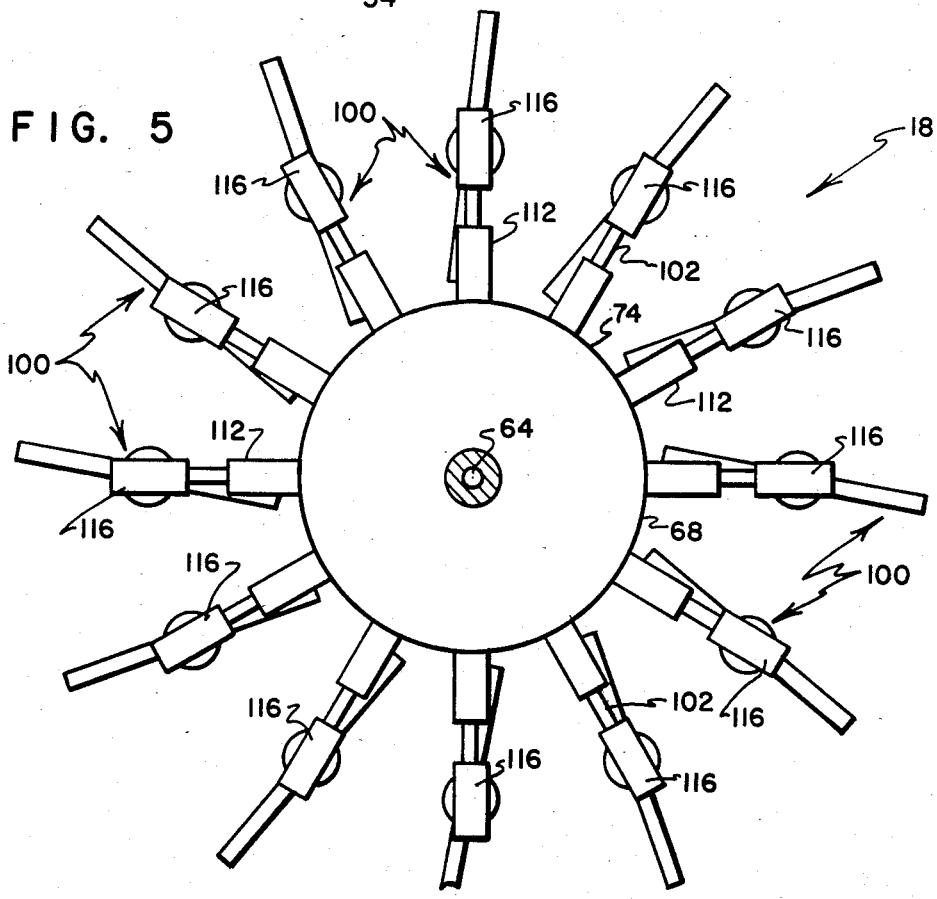

APPARATUS FOR MIXING AND SPREADING COATINGS ON SURFACES

CROSS-REFERENCE TO RELATED APPLICATION

The present application is a continuation-in-part of U.S. application Ser. No. 408,484, filed Aug. 16, 1982, entitled APPARATUS AND METHOD FOR APPLYING COATINGS TO TRAFFIC SURFACES, issued Oct. 16, 1984 as U.S. Pat. No. 4,477,203, hereinafter referred to as "the Parent Case," the disclosure of which is incorporated herein by reference.

BACKGROUND OF THE INVENTION

1. Field of the Invention

The present invention relates generally to the coating of what are generally referred to as "traffic surfaces," namely generally horizontally extending surfaces such as roads, driveways, parking lots, walkways, tennis courts, flat roofs, rainwater catchments and the like wherein the surface areas to be covered are of sufficient size to warrant the use of a coating machine. For convenience, these surfaces are referred to herein as "traffic surfaces," it being understood, however, that this term is not used in a restrictive sense and is not limited in scope to surfaces which accommodate vehicular traffic.

2. Prior Art

Traffic surfaces are exposed to wear and often to the effects of the elements, with the result that they are subject to deterioration. Accordingly they require protective coatings to extend their useful lives. These coatings may be applied at the time the surface is constructed, but are more frequently applied after a certain amount of use in order to restore the surface to a desirable condition.

In some cases, a coating is applied manually to a traffic surface using one or more long-handled applicators; however, if the surface area to be treated is sufficiently large, it is preferably treated by mobile equipment, such as machines which have tanks for carrying liquid or slurry-type coating material, dispensing apparatus for metering the coating material or materials onto the surface to be treated, and mechanisms for spreading and applying the coating in a thin uniform layer. In some cases, it is advisable to apply particulate material such as sand to the surface to improve frictional properties. Usually this has been done by separately applying the sand through its own dispensing mechanism.

A problem with previously proposed coating applicator machines is that they are generally intended for traveling along highways or other unobstructed surfaces in a basically unidirectional fashion, and are not well suited for working in confined or irregularly shaped areas. Moreover, the spreading and applicator tools used by these machines are not well suited for treating surfaces which have significant surface variations or which require a repetitive blading action to effect proper feeding and/or troweling of material into and about large cracks; nor are they well suited to the execution of such sharp sudden changes in direction as are required where a surface area to be treated is closely confined and/or where it is found necessary to refinish a particular portion of the surface. A significant limitation of prior applicator proposals is their inability to effectively admix in situ such materials as epoxy substances, fibrous, beaded or heavy particulates and/or quick setting soluble substances to form uniform slurry compositions.

Another problem with previously proposed machines is that they require power-driven propulsion units. This requirement renders most previously proposed machines expensive and bulky. In finishing smaller surfaces such as tennis courts, residential driveways, and the like, these heavy power-driven machines may do damage to the surfaces being treated; moreover, their lack of maneuverability inhibits proper surface treatment.

A further problem with most previously proposed machines is that they are of complex and expensive construction, whereby their relatively large purchase prices often render these machines unavailable to some small companies.

3. The Parent Case

The referenced Parent Case addresses certain of the foregoing and other drawbacks of prior proposals by providing a novel and improved system for applying coatings to traffic surfaces. However, there remains a need for a simple and inexpensive system for spreading and applying surface coating ingredients utilizing a machine which is manually maneuvered and which is well suited to accommodate traffic surfaces of moderate size which have closely confined boundaries, changing contours, and/or surface irregularities. As will be apparent from the description which follows, the present invention represents an extension of the system development work which forms the subject matter of the referenced Parent Case. As will also be apparent, certain of the improvements which form the subject matter of the present invention may be advantageously used with the system of the Parent Case.

SUMMARY OF THE INVENTION

The present invention addresses the foregoing and other drawbacks of the prior art by providing an apparatus which may be maneuvered manually with ease, and which is capable of spreading, mixing and applying coating ingredients on smooth and/or irregular traffic surfaces regardless of whether the surfaces have closely confined boundaries, changing contours, and/or surface irregularities.

An apparatus embodying the preferred practice of the invention includes includes a support carriage, a frame and a power-driven finishing assembly. The finishing assembly is provided with a plurality of working tools which are rotated about a central axis to bring the tools sequentially into contact with a traffic surface area being treated to efficiently spread and apply a surface treatment composition. Radially extending arms connect with the working tools and with a central support disc. The arms independently urge the tools toward the traffic surface to maintain the tools in contact with the surface despite surface variations. Adjustable couplings connect the tools to the arms to enable the tools to be selectively positioned and easily repositioned relative to the arms to further enhance the maintainence of good tool-to-surface contact and to permit the angle of inclination of a tool relative to its supporting arm to be controlled for tilt and lag to minimize tool "chatter" and to optimize the troweling effect achieved on a particular surface being treated.

In preferred practice, the tools include a spreading tool which takes the form of a blade, and a mixing tool which takes the form of a rake. Blade and rake tools preferably are mounted in an alternating array for sequential contact with portions of a surface being treated. Alternatively, blade and rake tools may be mounted in spaced tandem relationship and carried together on selected ones of the arms. The tools are preferably rotated about the central axis by an engine-driven gear reducer.

Movement of the apparatus over a surface being treated is preferably effected manually by an operator who applies force to a frame-carried handle. The support carriage is preferably provided with a plurality of centrally mounted, ball-type wheels which permit the operator to readily maneuver the machine and effect coating operations within small treatment areas and within areas having irregular boundaries.

A feature of the present invention lies in the provision of a finishing apparatus which is capable of mixing, spreading and applying coating ingredients with a desired degree of uniformity to traffic surfaces having surface variations and/or irregular contours. In preferred practice, a plurality of spreading and/or mixing tools are connected to a common drive shaft by a plurality of radially extending arms which are capable of independent vertical movement as their associated tools encounter surface irregularities. Additionally, each tool is preferably pivotally connected to further enhance the tools' freedom of movement to accommodate changing surface contours and/or surface irregularities.

A further feature of the invention lies in the provision of a finishing apparatus which is easily maneuvered and able to respond to such abrupt changes in direction as may be required to accommodate surfaces having irregular boundaries, and/or to effect correction of a coating application which has been applied to a nearby surface area. The apparatus is preferably supported at least in part, by a carriage which includes a plurality of centrally located ball-type wheels. An advantage of the use of ball-type wheels is that they do not limit the direction of movement of the machine. To the contrary, they enable the operator to quickly, easily and abruptly change the direction of movement of the apparatus as he sees fit during a coating application. The ball-type wheels are preferably provided with knife-edge and wiping assemblies which serve to continually remove particulate matter from the wheels as they rotate, thereby preventing buildup of contaminates that might otherwise impede ready maneuvering of the apparatus. Each of the wheel assemblies defines an enclosed lubrication chamber for applying a film of lubrication to the surface of its associated ball as the ball rotates.

Still another feature of the present invention lies in the provision of a finishing apparatus capable of effecting uniform, in situ mixing of viscous coating ingredients. In preferred practice, the finishing apparatus utilizes an array of alternating mixing and spreading tools. Rake-like mixing tools serve to break up and mix particulate coating ingredients with viscous slurry coatings. Blade-like spreading tools effect application of coating materials with a desired degree of uniformity.

BRIEF DESCRIPTION OF THE DRAWINGS

The foregoing and other features of the invention will be better understood by referring to the description of the preferred embodiment and the claims which follow, taken together with the accompanying drawings, wherein:

FIG. 4 is a top plan view of the apparatus of FIG. 1;

FIG. 5 is a sectional view as seen from a plane indicated by a line 5—5 in FIG. 1;

DESCRIPTION OF THE PREFERRED EMBODIMENT

Figure 1:
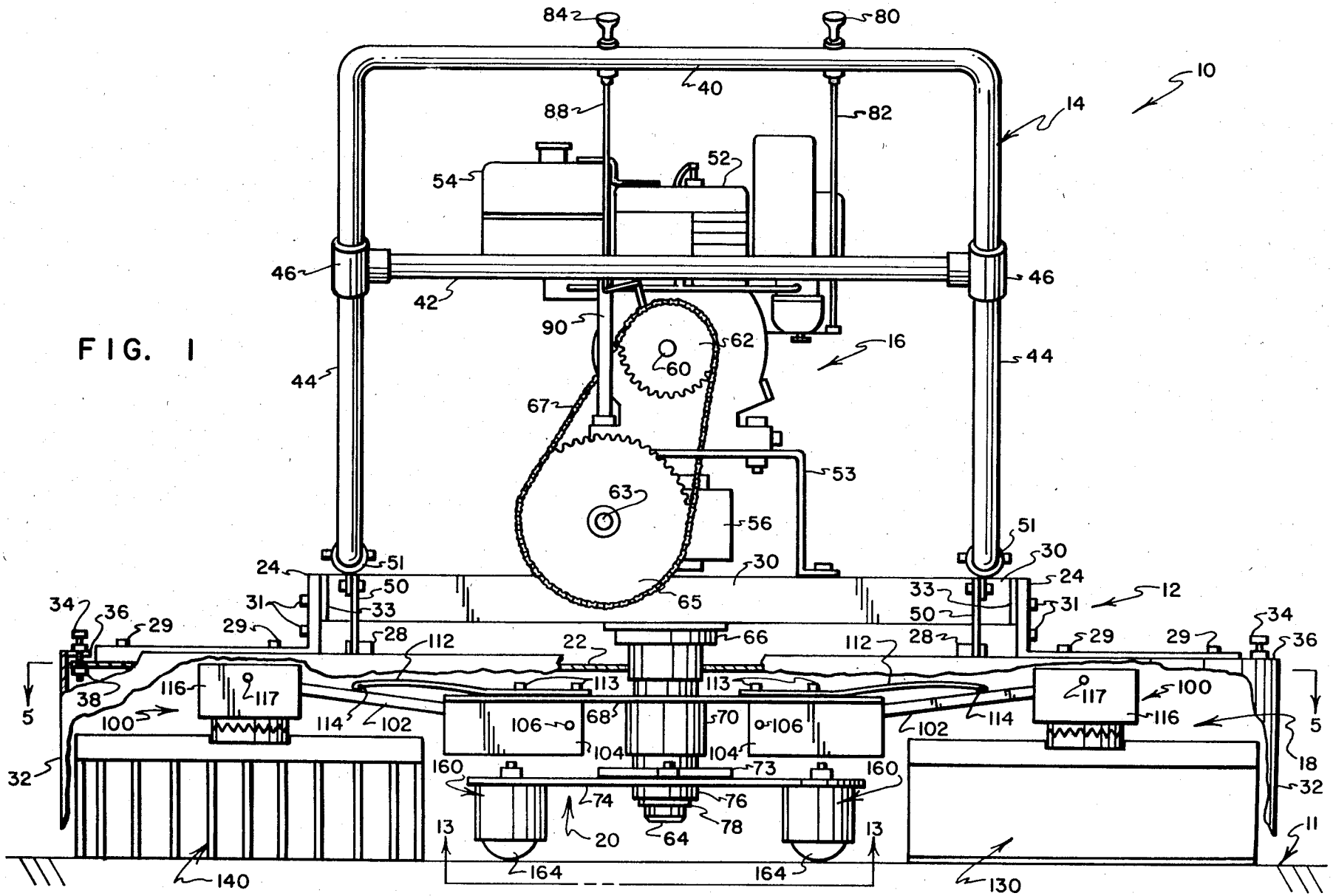
FIG. 1 is a front end elevational view of a finishing apparatus embodying the preferred practice of the present invention, with portions broken away to permit underlying structures to be viewed, as seen from an operator's position.
Figures 2, 3:
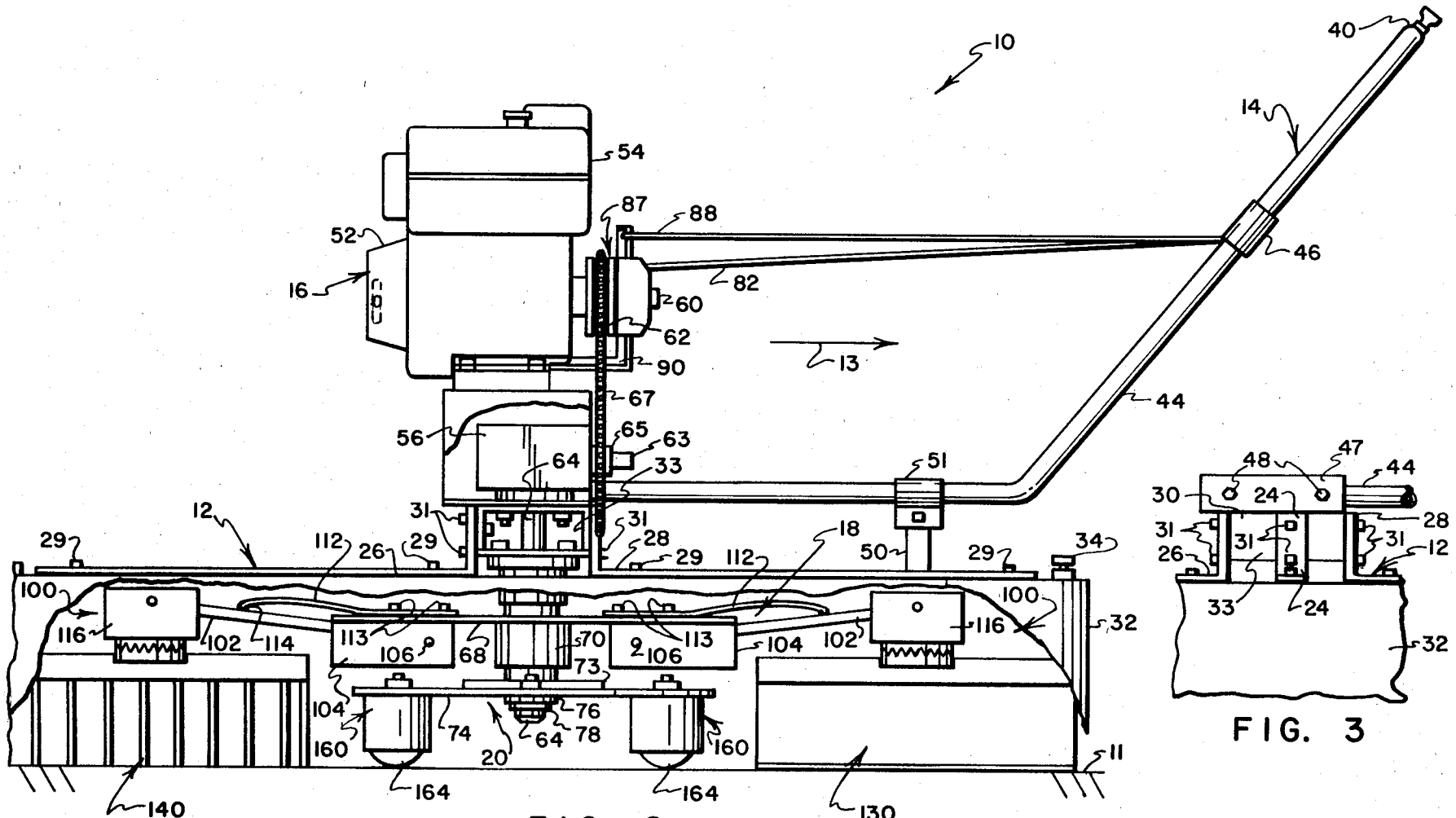
FIG. 2 is a side elevational view of the apparatus of FIG. 1, with portions broken away.
FIG. 3 is a side elevational view of portions of the apparatus, parts which are broken away in the view of FIG. 2.

Referring to FIGS. 1, 2 and 4, an apparatus for mixing and applying coating substances to traffic surfaces is indicated generally by the numeral 10. In FIGS. 1 and 2 the machine 10 is shown positioned on a traffic surface 11. The machine 10 includes a frame which is indicated generally by the numeral 12, a U-shaped handle 14, a power drive unit 16, a mixing and finishing assembly 18 (best seen in FIGS. 1, 2 and 4), and a central support carriage 20 (best seen in FIGS. 1, 2 and 14). While the finishing assembly 18 is described as embodied in the machine 10, it may also be utilized in the system of the referenced Parent Case.

The machine 10 is intended to be moved over the traffic surface 11 by an operator who manually maneuvers the machine 10 by applying force to the U-shaped handle 14. As the machine 10 moves over the surface 11, it mixes, distributes and effects application to the surface 11 of such coating substances as have been manually or otherwise deposited on the surface 11. While a forward path of travel for the machine is indicated in FIGS. 2 and 4 by the numeral 13, it will be understood by those skilled in the art that the machine 10 may be moved about on the surface 11 in substantially any horizontally-oriented direction. Accordingly, the designation of a "forward" travel path is simply for purposes of facilitating reference to various machine components by describing their orientation relative to the designated travel path, and should not be construed as limiting the scope of the invention.

As will be explained, the central support carriage 20 and tools 100 which form part of the assembly 18 engage the surface 11 and cooperate to support the frame 12 during operation of the machine 10. The frame 12, in turn, mounts, interconnects and supports many of the components of the machine 10.

The frame 12 includes an assembly of a circular cover or deck 22, three pairs of L-shaped brackets 24, 26, 28, a channel-shaped structural frame member 30 and a cylindrical shield or skirt 32. The L-shaped brackets 24, 26, 28 each have horizontally extending legs which are connected to the deck 22 by threaded fasteners 29, and upstanding legs which are connected by threaded fasteners 31 to a depending end and side flange portion 33 of the structural frame member 30.

Referring to FIGS. 1 and 2, the brackets 24 are fastened to the cover or deck 22 in spaced relation along an imaginary line of diameter extending transversely relative to the forward travel path 13. Referring to FIGS. 2 and 4, the brackets 26 are fastened to the deck 22 at locations extending rearwardly across the deck 22 with respect to the direction of the forward travel path 13. The brackets 28 are fastened to the deck 22 at locations aligned with the brackets 26 but extending forwardly across the deck 22 with respect to the direction of the forward travel path 13.

The cylindrical skirt 32 is attached to and depends from the deck 22. The skirt 32 extends perimetrically about the mixing and finishing assembly 18 and helps to confine any splatter or spray resulting from the operation of the machine 10, and provides a guard against accidental injury to persons who might otherwise inadvertently come into contact with the rotating finishing assembly 18. The skirt 32 has a perimetrically extending, inwardly turned top flange 36 which overlies peripheral portions of the deck 22. The flange 36 strengthens and rigidifies the skirt 32, and carries adjustable fasteners 34 at spaced locations along its circumference which are arranged to permit the skirt 32 to be elevated or lowered relative to the plane of the deck 22 so that the bottom edge of the skirt 32 may be positioned as desirably close to the traffic surface 11 as is practical, taking into account the irregularities and contours of the particular traffic surface being treated.

The apparatus control handle 14 is of tubular, generally U-shaped construction having a pair of leg portions 44 which are interconnected by an integrally formed grippable cross member portion 40. A reinforcing cross member 42 also interconnects the legs 44 and is connected thereto by couplings 46. Ends of the legs 44 extend into sleeve-type couplings 47 carried on the frame member 30. Bolts 48 secure the legs 44 to the couplings 47.

The handle 14 extends forwardly from the assembly 18 so that an operator walking ahead of the machine 10 along the forward travel path 13 can manually guide and move the machine 10. While the machine 10 is most easily described by utilizing such directional terms as "forward" and "rearward," it will be understood that the machine 10 may be moved in any chosen direction across the surface 11. Accordingly, the use of such directional terms as "forward" and "rearward" should not be deemed to be limiting.

Referring again to FIGS. 1 and 2, the power drive unit 16 is mounted atop the frame member 30 at a location which is substantially central to the machine 10 to maintain proper machine balance. The power drive unit 16 includes a power source such as an internal combustion engine 52, a fuel tank 54, and a gear reducer 56. The engine 52 is mounted over the gear reducer 56 on a bracket 53. Referring to FIG. 2, the engine 52 has an output shaft 60 carries a clutch assembly 87 which drivingly connects the shaft 60 with a drive sprocket 62. The gear reducer 56 has an input shaft 63 which carries an input sprocket 65. A chain 67 is reeved around the sprockets 62, 65 to drive the input shaft 63 from the output shaft 60.

Referring to FIGS. 1 and 2, the gear reducer 56 is bolted to the frame member 30 and drives an output shaft, designated by the numeral 64, which extends upwardly into and drivingly connects with a hollow-bore output sleeve (not shown) of the gear reducer 56. The shaft 64 depends substantially vertically through a hole (not shown) that is formed substantially centrally through the deck 22. The shaft 64 extends through a thrust bearing assembly 66 that is connected to the frame member 30. The shaft 64 has a shoulder (not shown) that engages the thrust bearing 66 to enable the weight of the deck 22 and such other components as are supported by the frame member 30 and by the deck 22 to be imposed on the shaft 64. Since the bearing 66 is spaced downwardly from the gear reducer 56, the engagements made by the shaft 64 with the gear reducer 56 and with the bearing 66 are at spaced positions along the length of the shaft 64, whereby a sturdy supporting connection is established between the shaft 64 and the relatively heavy load that is carried by the shaft 64. The shaft 64 continues downwardly through a tool support disk 68 and through a sleeve 70 which is rigidly connected to the disk 68. The sleeve 70 is keyed to the shaft 64 so that the sleeve 70 and the shaft 64 are caused to rotate in unison. The shaft 64 continues downwardly through a thrust bearing assembly 73 and through a bearing 76 which are connected to an annular support plate 74. The shaft 64 has a radially extending shoulder (not shown) which makes a transition to a relatively small diameter end portion of the shaft 64, and it is this shoulder that is engaged by the thrust bearing assembly 73 so that the shaft 64 and the weight load that is carried by the shaft 64 are transmitted by the thrust bearing assembly 73 to the support plate 74. A retaining ring 78 is provided near the lower end of the shaft 64 to retain the support plate 74 and the thrust bearing assembly 73 in place relative to the shaft 64.

Referring to FIG. 1, the speed of the rotating shaft 64 is controlled by a throttle lever (not shown) carried on the engine 52. The throttle is manually operated by a throttle control knob 80 which is movably supported by the handle 14. The throttle control knob 80 is connected to the engine-carried throttle by a flexible control cable 82 which extends from the control knob 80 through a hole formed in the cross member 42. In a like manner a clutch control knob 84 is supported by the handle 14 and is connected to a clutch operating lever (not shown) by a flexible control cable 88 through a support bracket 90. The engine-carried clutch 87 serves to drivingly engage and disengage the engine 52 from the gear reducer 56.

Referring to FIG. 5 the finishing assembly 18 includes the central disk 68 and a plurality of radially extending tools 100. As previously described the disk 68 is connected to the drive shaft 64 to effect rotary movement of tools 100.

Figure 7:
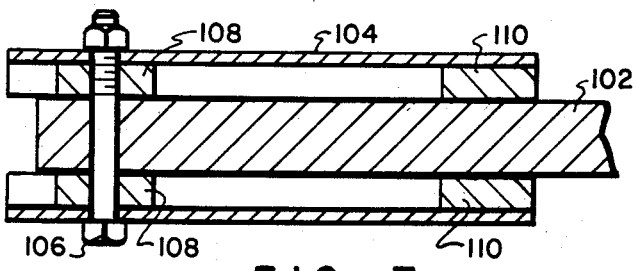

Referring to FIG. 1, one of the arms 102 which connects a tool 100 to the disk 68 is shown. The arm 102 is pivotally connected by a bolt 106 to a rectangular bracket 104 which depends from the central disk 68. Referring to FIG. 7, a pair of flat heading washers 108 are disposed between opposed inner surface portions of the bracket 104 and opposed sides of the arm 102. A pair of bearing guide plates 110 are carried by the bracket 104 in the vicinity where the arm 102 extends outwardly from the bracket 104. The washers 108 and the guide plates 110 serve to confine the arm 102 to pivotal movements about the axis of the bolt 106, and enable the arm 102 to move the tool 100 vertically so that the tool 100 may be maintained in contact with the traffic surface 11 despite variations and irregularities in the surface 11.

Referring to FIG. 1, the tools 100 are biased toward the traffic surface 11 by leaf springs 112 which are fastened to the disk 68 by a pair of bolts 113. The bolts 113 also serve to connect the brackets 104 to the disk 68. Each of the leaf springs has a distal end 114 which rests atop a separate one of the arms 102.

Figure 6:
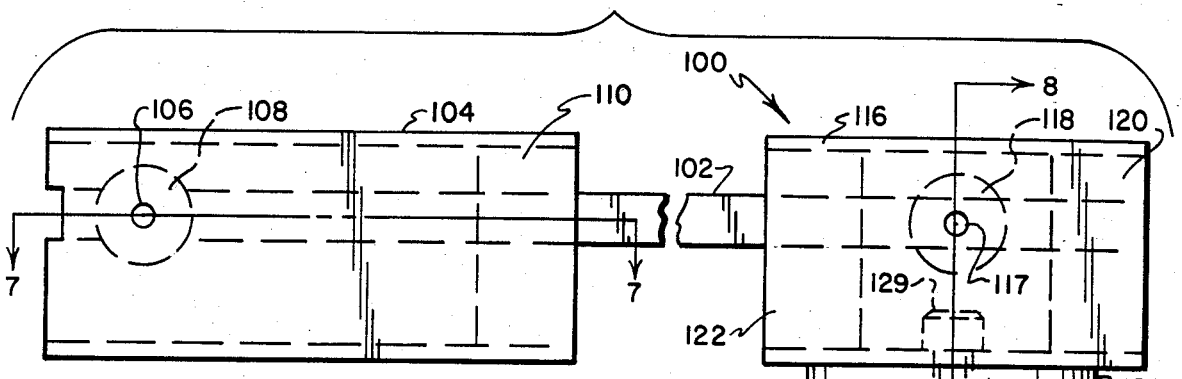
FIG. 6 is an enlarged, foreshortened side elevational view of one embodiment of a spreading tool utilized in the apparatus of FIG. 1.
Figure 8:
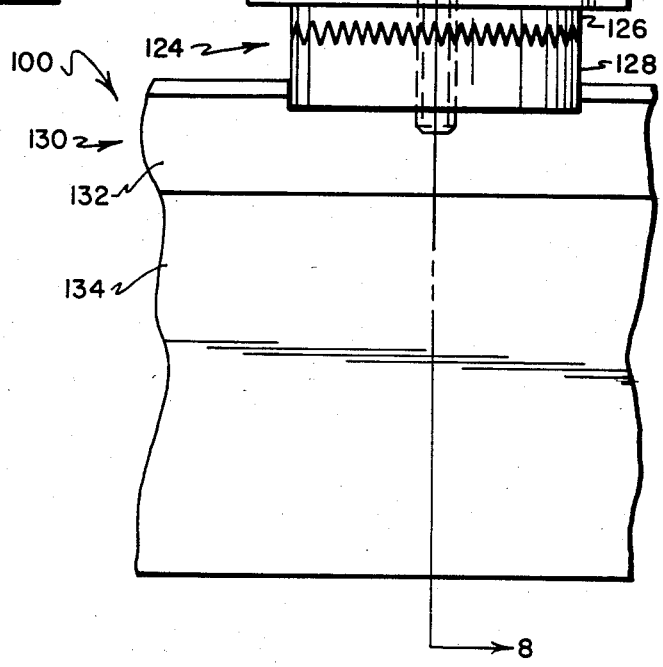
FIGS. 7 and 8 are sectional views as seen from planes indicated by the line 7—7 and 8—8, respectively, in FIG. 6.
Figure 8:
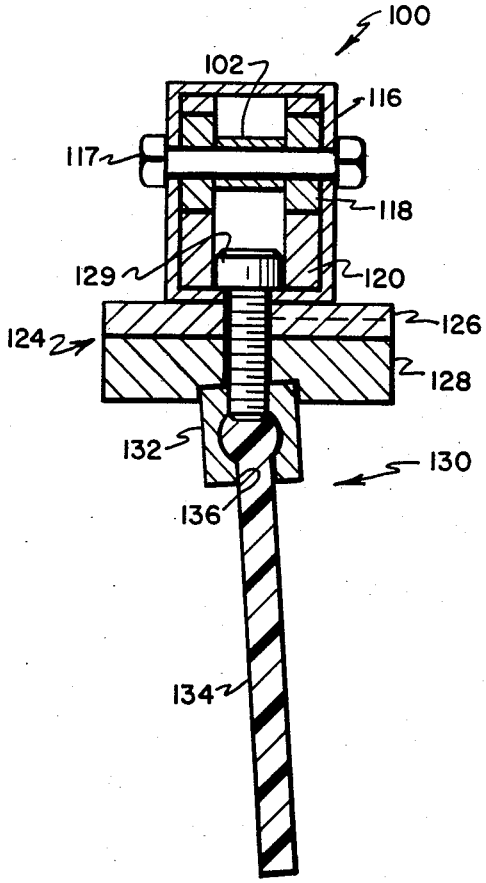

Referring to FIGS. 6 and 8, the tool 100 is pivotally connected by a bolt 117 to an outer end portion of the arm 102 by a rectangular bracket 116 which is similar to the bracket 104. A pair of bearing washers 118 are disposed between opposed sides of the arm 102 and opposed inner side walls of the bracket 116 to insure that the bracket 116 is allowed to pivot freely about the bolt 117. Two pairs of guide bearing plates 120, 122 are disposed near the inner and outer ends of the bracket 116, and engage opposed sides of the arm 102. The pivotal attachment of the tool 100 to the arm 102 permits the tool 100 to pivot about the axis of the bolt 117 in response to engagements with irregular contours in the surface 11.

A toothed coupling 124 is carried by a lower portion of the bracket 116. The coupling 124 includes an upper half 126 and a lower half 128. The upper half 126 of the coupling 124 depends from and is rigidly connected to the bracket 116. The lower portion of the coupling 128 carries the tool 100. The upper and lower halves 126, 128 of the coupling 124 are clamped into engagement by a bolt 129. The angle of attachment of the tool 100 relative to the arm 102 may be adjusted by loosening the bolt 129, disengaging the coupling halves 126, 128, rotating the tool 100 to the desired angle, and re-engaging the halves 126, 128 by tightening the bolt 129.

Figure 12:
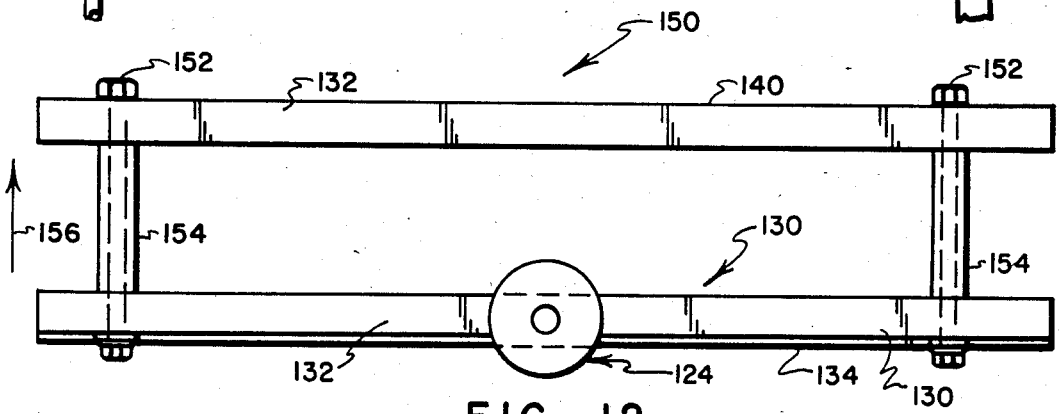
FIG. 12 is a top plan view of the tandem tool assembly of FIG. 11.
Figure 13:
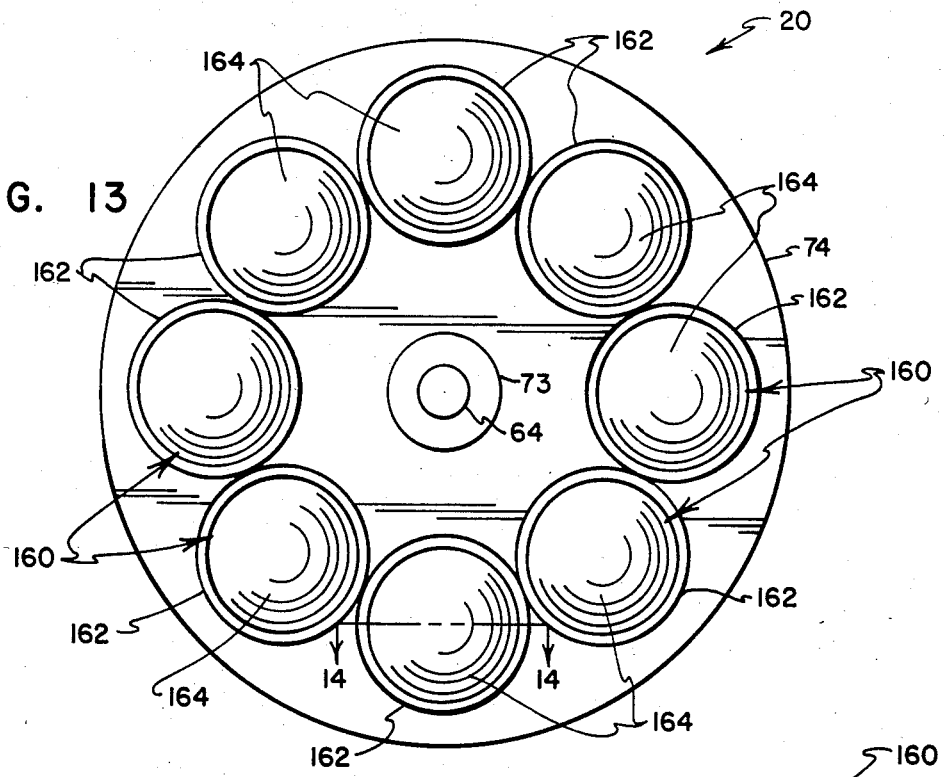
FIG. 13 is a bottom plan view of a support carriage having a plurality of ball-type wheels, as seen generally from a plane indicated by a line 13—13 in FIG. 1; and, FIG. 14 is an enlarged sectional view of a single ball-type wheel as seen from a plane indicated by a line 14—14 in FIG. 13.

The tool 100 may take either of two preferred forms: it may comprise a single blade-like applicator 130 as depicted in FIGS. 6 and 8, or it may include both a blade-like applicator 130 and a mixing tool 140, as depicted in FIGS. 12 and 13. The finishing tool 130 takes the form of a blade structure 134 which is mounted in a head assembly 132. The head assembly 132 is connected to the lower half of the coupling 128 by a bolt 129 which extends through the lower portion of the bracket 116, through the coupling 124, through a threaded portion of the head assembly 132, and into engagement with the blade 134. The head assembly 132 is preferably an extrusion of relatively rectangular outer dimension with a keyhole-shaped groove 136 formed therein, as can best be seen in FIG. 8. The head 132 is carried by the lower coupling 128 and extends at an acute angle relative to the traffic surface 11 so that the blade 134 is inclined rearwardly relative to the direction of rotation of the tool 100 to improve the resulting finishing effect.

Figure 9:
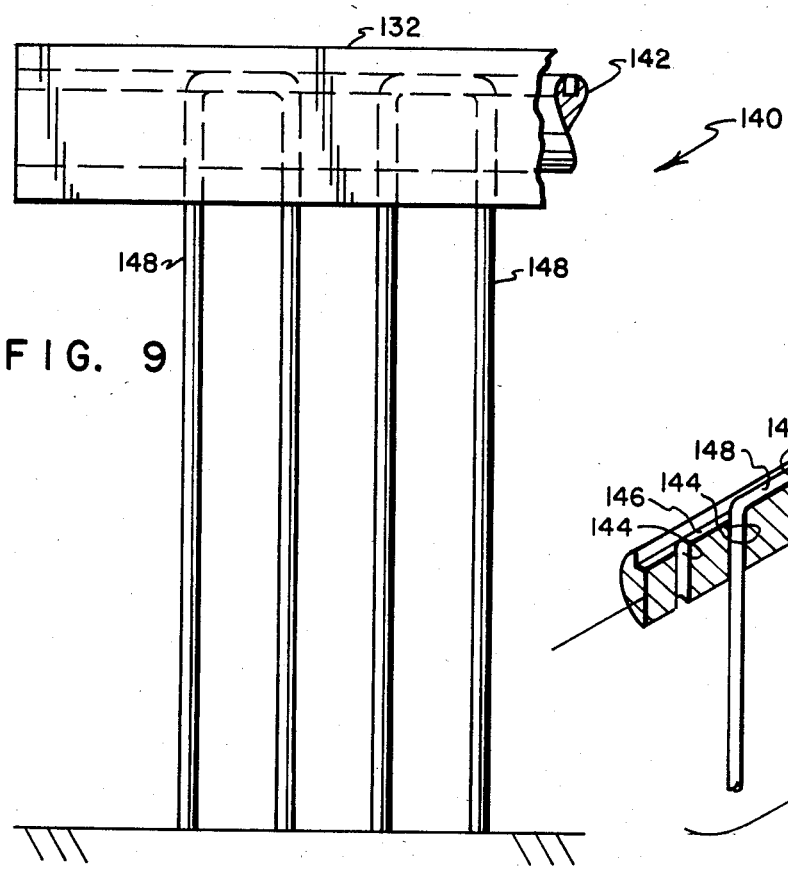
FIG. 9 is a side elevational view of an alternate form of tool for use with the apparatus of FIG. 1.
Figure 10:
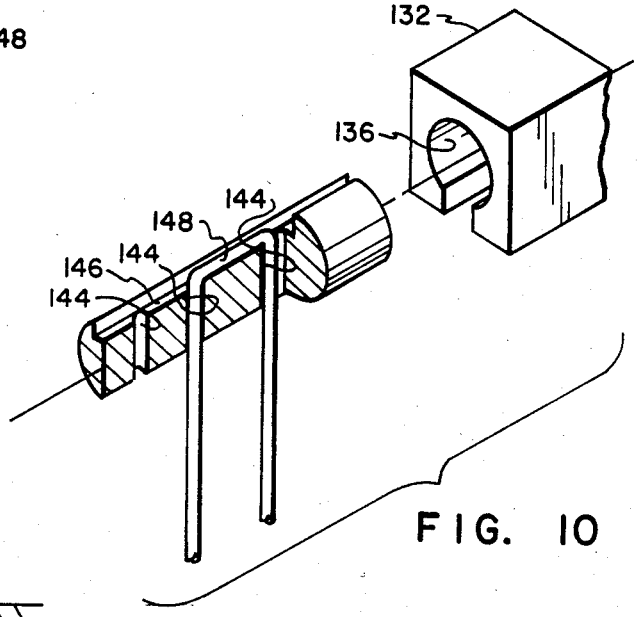
FIG. 10 is a perspective, exploded view showing selected portions of the mixing tool of FIG. 9.

Referring to FIG. 9, the mixing tool 140 is shown. The tool 140 serves to break up large particulate matter which may be deposited on the traffic surface 11 so that the tool 130 can uniformly spread the material. The mixing tool 140 takes the form of a mandrel 142 which is of sufficient diameter to fit into the groove 136 of the head 132. A series of vertical holes 144 are formed through the mandrel 142, as is shown in FIG. 10. The holes 144 are connected by a groove 146 which is formed a long the upper surface of the mandrel 142. The mixing tool 140 is formed by inserting U-shaped tines 148 through adjacent pairs of the holes 144 with the top portion of the U-shaped tines 148 being recessed in the grooves 146. The grooves 146 are of sufficient depth so that the top portion of the tines 148 are flush with the outer surface of the mandrel 142 to permit the assembly of the mandrel 142 and the tines 148 to be inserted into the head 132. The tines 148 are of sufficient length to allow them to be dragged along the surface 11 to effect a mixing and breaking action of the coating materials deposited on the traffic surface 11.

In preferred practice, the mixing tools 140 and the spreading tools 130 are used together on the machine 10, and are arranged so that tools 130 alternate with the tools 140 on adjacent arms 102. Other arrays of the tools 130, 140 are also within the purview of the present invention, as will be understood by those skilled in the art.

Figure 11:
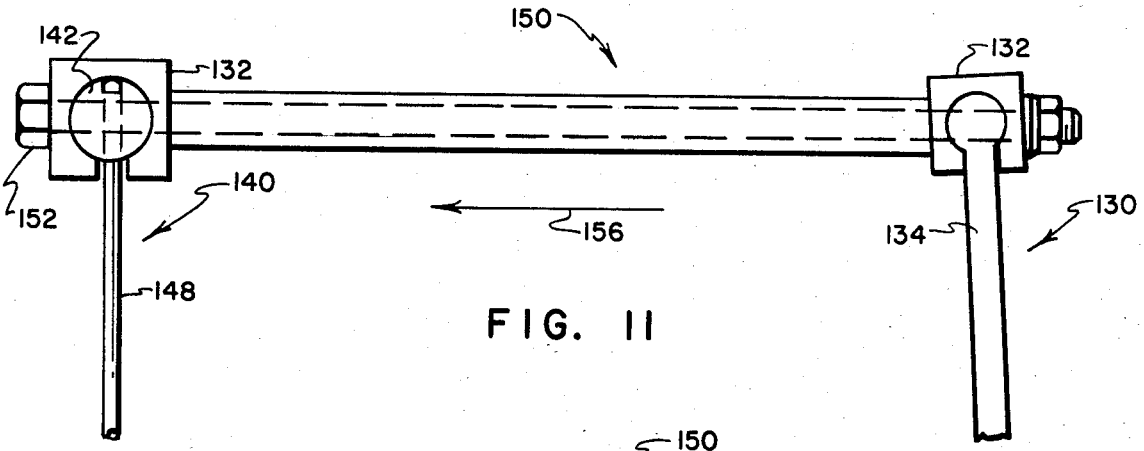
FIG. 11 is an end elevational view of still another alternate tool assembly embodiment alternative which includes a spreading tool and a mixing tool mounted in tandem.

Referring to FIGS. 11 and 12, still another alternate embodiment 150 of the tool 100 is shown. In the embodiment 150, the spreading tool 130 and mixing tool 140 are connected and held in spaced parallel relationship by a pair of bolts 152 which extend through the head assemblies 132 of each of the tools 130, 140 to form a combined tool 150. A pair of sleeves 154 are provided between the tools 130, 140 to keep them in spaced, parallel relationship. Where the tool embodiment 150 is employed, the spreading tool 130 is connected to the splined couplings 124 and is carried by the bracket 116. The mixing tools 140 are arranged to precede the spreading tools 130 with respect to the direction of rotation of the finishing assembly 18, as is indicated in FIGS. 11 and 12 by the arrow 156.

Referring to FIGS. 1, 2 and 13, the carriage 20 includes the circular support plate 74 and a plurality of ball wheels 160. In the machine 10, a total of eight wheels 160 are preferably used. The circular support disk 74 is preferably formed of a somewhat flexible metal material so that the support plate 74 may itself act as a shock absorber as the machine 10 is moved across the traffic surface 11. The carriage 20 serves to support the weight of the machine 10 by rotatably receiving the drive shaft 64 in the thrust bearing 73 as previously described.

Figure 14:
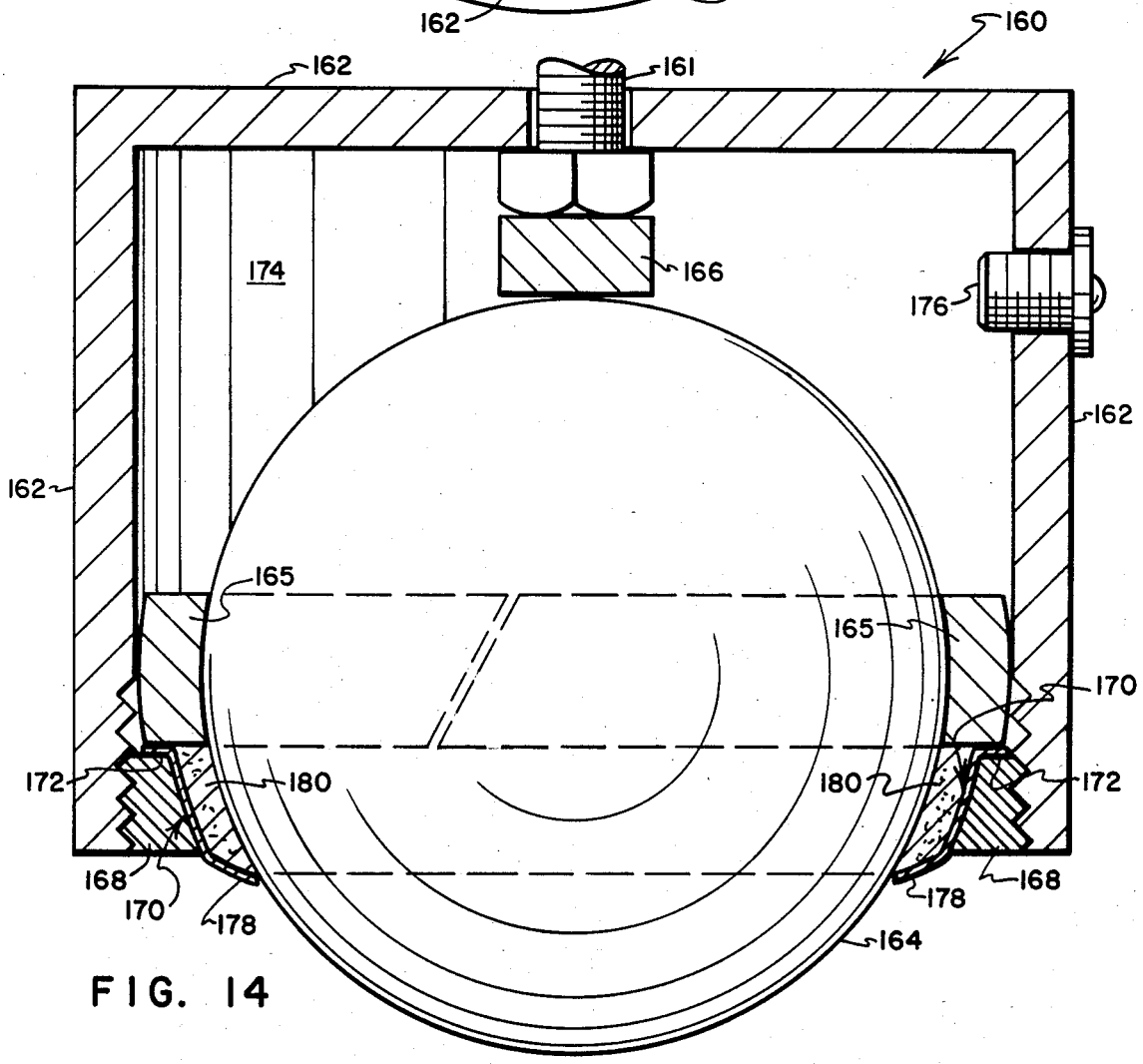

Referring to FIG. 14, one of the ball wheels 160 is shown. The ball wheel 160 includes a cylindrical, downwardly opening housing 162 and a ball 164. The housing 160 is attached to the plate 74 by a bolt 161. The ball 164 is partially encased in the housing 160 and is kept spaced apart from the inside walls of the housing 160 by a split coupling bearing 165 and a thrust bearing pad 166. The split coupling bearing 165 encircles a midsectional portion of the ball 164 and allows the 164 to move freely within the housing 162. The thrust pad bearing 166 is connected to the bolt 161 and serves to allow the ball 164 to rotate without touching the upper wall of the housing 162.

The ball 164 is secured in the housing 162 by a threaded locking ring 168. The ring 168 threadably engages the lower, inner portion of the housing 162 and underlies the bearing 165. An annular collar 170 lines inwardly facing surfaces of the locking ring 168 and is specially configured from spring material to provide an outwardly turned flange 172 which overlies the upper end of the locking ring 168, and a depending, inwardly turned lip 178 which extends below the locking ring 168 and closely surrounds the ball 164. The lip 178 of the collar 170 serves to remove particulate matter from the surface of the ball 164 as the ball 164 rotates. Carried internally of the collar 170 is an inner band 180 of material which carries a lubricant and serves to assist the lip 178 in removing small particulate matter from the surface of the ball 164. As the thrust pad 166 wears from use, the locking ring 168 may be tightened to compensate for wear and to assure that the ball 164 is securely retained in the housing 162.

A chamber 174 is defined within the housing 162. In preferred practice, the chamber 174 is at least partially filled with a lubricant such as grease to keep the surface of the ball 164 lubircated and to impede the attachment of particulate matter to the ball 164. A plug 176 is provided in an opening formed through the housing 162 to enable the chamber 174 to be charged with lubricant.

The ball wheels 160 render the finishing machine 10 highly maneuverable, and give it a capability to change direction readily. The lubricated surfaces of the ball wheels 160, the cleaning action of the lip 178, and the operation of the band 170 keep the ball wheels 160 free from contaminants and permit them to rotate freely as the machine 10 is moved across the traffic surface 11.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A manually translated rotary tool apparatus for forming a coating composition on a traffic surface by mixing and spreading previously applied ingredients deposited thereon and for smoothly spreading the same thereover irrespective of the lateral traffic surface dimensions, comprising:

a frame having vertically directed thrust bearing means about a vertical axis of rotation, power drive means carried on the frame means on the upper side thereof and including a drive shaft extending through said bearing to the frame underside, carriage means disposed about said axis and including a thrust bearing receiving said drive shaft for supporting the frame and drive means thereby, said carriage means including a plurality of ball wheels providing traffic surface support thereby to permit manual translation of said apparatus in any lateral direction with respect to the traffic area undergoing treatment, a plurality of tool arms connected to and extending radially from said shaft, a surface-engaging tool connected to each said arm at its distal end whereby said tools will rotate in a horizontal plane upon rotation of said drive shaft by said power means thereby to effect treatment of the traffic surface, means mounting each said tool arm for pivotal motion in a vertical plane with respect to said drive shaft and with respect to said tool connected thereto to accommodate irregularities in the treated surface while maintaining the orientation of the tool with respect thereto as said tool arms undergo pivotal vertical motion during orbiting rotation, and, means yieldably biasing said tool arms downwardly to maintain said tool in contact with the treated surface.

2. The apparatus of claim 1 further including means for adjusting each tool about a vertical axis with respect to its tool arm thereby to predetermine the character and extent of treatment applied to the traffic surface.

3. The apparatus of claim 1 wherein the carriage means thrust bearing includes means formed from relatively flexible means for providing a shock-absorbing action for the carriage means as the apparatus moves over a traffic surface.

4. The apparatus of claim 1 additionally including shield means having a cylindrical shield for perimetrically surrounding at least portions of the frame means, and adjusting means for vertically adjusting the position of the shield means with respect to the frame means.

5. The apparatus of claim 1 additionally including dispensing means carried by the frame means for dispensing at least one coating ingredient onto a traffic surface to be applied to the traffic surface by the apparatus.

6. The apparatus of claim 1 wherein at least one of the arms carries at least a pair of said tools in spaced tandem relationship for bringing the tools of said pair sequentially into engagement with portions of traffic surface being treated.

7. The apparatus of claim 6 wherein one of the tools of said pair is a blade for troweling material being applied to a traffic surface, and the other of the pair of tools is a rake for mixing material being applied to the traffic surface.

8. The apparatus of claim 1 wherein the mounting means includes a head structure connected to the distal end region of at least one of the arms, and at least one of the tools includes a first tool having a blade structure supported upon and depending from the head structure, with the connection that is formed between the blade structure and the associated arm by the head structure being such that the blade structure is caused to extend at an angle of inclination relative to the vertical.

9. The apparatus of claim 8 wherein at least another of the tools includes a second tool that differs in configuration from the blade structure of the first tool, and the first and second tools are connected, respectively, to outer end regions of separate ones of the arms.

10. The apparatus of claim 9 wherein the second tool includes an elongate support structure having depending tine means including a plurality of tines that depend from the support structure at spaced positions therealong for effecting mixing of coating ingredients in situ on a traffic surface.

11. The apparatus of claim 1 wherein at least one of the ball wheels includes:

(a) a ball;

(b) a housing which at least partially encases the ball and defines a lubricant chamber for containing a lubricant to lubricate the ball as the ball moves relative to the housing; and, (c) bearing means interposed between the ball and the housing for journalling the ball for engagement with a traffic surface and for rotation relative to the housing as the apparatus is moved across the traffic surface.

12. The apparatus of claim 11 wherein:

(a) the at least one ball wheel additionally includes cleaning means for removing particulate matter from the surface of its associated ball as the ball rotates relative to the housing; and, (b) the housing includes a downwardly opening housing member which carries internal threads, and an externally threaded locking ring which is threaded into the housing for adjustably clamping the ball and the cleaning means in place.

13. The apparatus of claim 12 wherein the cleaning means includes:

(a) a band which is disposed between the housing and the ball, and which encircles a portion of the ball, the band having lubricating properties; and, (b) a circular lip structure connected to the housing and engaging the ball to scrape particulates off of the ball as the ball rotates relative to the housing.

14. The apparatus of claim 11 wherein the bearing means includes a thrust pad that engages an upper portion of the ball, and a split coupling bearing band that encircles a substantially horizontally extending region of the ball.

* * * * *